US008238581B2

(12) United States Patent
Hofrichter

(10) Patent No.: US 8,238,581 B2
(45) Date of Patent: Aug. 7, 2012

(54) POWERED SUBWOOFER/SPEAKER REMOTE TURN-ON FUNCTION

(76) Inventor: Richard Hofrichter, Glen Allen, VA (US)

( * ) Notice: Subject to any disclaimer, the term of this patent is extended or adjusted under 35 U.S.C. 154(b) by 1423 days.

(21) Appl. No.: 11/251,705

(22) Filed: Oct. 17, 2005

(65) Prior Publication Data

US 2008/0069392 A1 Mar. 20, 2008

(51) Int. Cl.
*H04R 3/00* (2006.01)

(52) U.S. Cl. ..... 381/116; 381/55; 381/59; 381/111; 381/123; 381/394

(58) Field of Classification Search ..... 381/111, 381/116, 55, 59, 120, 123, 300, 386, 394
See application file for complete search history.

(56) References Cited

U.S. PATENT DOCUMENTS

| | | | | |
|---|---|---|---|---|
| 4,475,231 | A * | 10/1984 | Elster | 381/87 |
| 5,347,230 | A * | 9/1994 | Noro | 330/297 |
| 5,422,631 | A * | 6/1995 | Gertz | 340/825.25 |
| 5,731,947 | A | 3/1998 | Hirose | |
| 6,589,170 | B1 | 7/2003 | Flach et al. | |
| 6,744,150 | B2 | 6/2004 | Rendic | |
| 6,813,221 | B1 | 11/2004 | Barr | |
| 6,832,199 | B1 | 12/2004 | Kucek et al. | |
| 6,849,045 | B2 | 2/2005 | Lliff | |
| 2002/0076063 | A1 * | 6/2002 | Caldwell | 381/98 |
| 2006/0072776 | A1 * | 4/2006 | Vishwamitra | 381/388 |

* cited by examiner

*Primary Examiner* — Devona Faulk
*Assistant Examiner* — Paul Kim
(74) *Attorney, Agent, or Firm* — Hiscock & Barclay, LLP

(57) ABSTRACT

The present invention provides a powered speaker, such as a subwoofer that may be turned on and off remotely by energizing the auxiliary AC power supply provided with an audio device or other source unit. The main power of the powered subwoofer is provided via a wall outlet or suitable power supply that may adequately supply the necessary power.

15 Claims, 2 Drawing Sheets

POWERED SUBWOOFER/SPEAKER REMOTE TURN-ON FUNCTION

FIELD OF THE INVENTION

This invention relates to audio equipment, and more particularly to a powered speaker having a remote turn on function.

BACKGROUND OF THE INVENTION

In audio/visual equipment, powered subwoofers, the speakers dedicated to creating the low-frequency (bass) audio critical in multichannel movie soundtracks like Dolby Digital 5.1, 7. 1, and DTS 5.1, 6.1, and 7.1, as well as music, have become extremely popular. Such a subwoofer typically receives a line-level audio signal from a source unit, such as a receiver, preamplifier, processor, or a combination thereof, and amplifies it with an internal amplifier. As such, these powered subwoofers have an electrical cord that is plugged into a standard household electrical outlet that supplies the internal amplifier with electricity.

Additionally, powered loudspeakers, which operate in a similar fashion as powered subwoofers but use one or more internal amplifiers to power all audio frequencies including the mid-range and higher (treble) pitches, have similar power characteristics although they are not as popular in the consumer market. Collectively, the powered loudspeakers and subwoofers are referred to as powered speakers or devices.

Problems arise, though, when turning the devices on and off. Ideally, powered speakers should be energized when, and only when, the source unit is also energized. However, more typically, the user is expected to manually turn these devices on and off each time they want to use them. Because this can be burdensome in some situations, the device's settings are typically ignored by users once they are initially set up and the audio output is configured.

As powered speakers or devices are currently configured, they may be manually left on or off. If the device is left on at all times, unnecessary consumption of energy, unwanted ambient noise when the system is not being used, and potential damage to the electrical components within the device may result. Further, leaving the powered speaker on may emit excess heat resulting in discomfort to the user, or diminishing the performance of neighboring equipment. If the device is left off, the device will often be suboptimally used as owners will forget to turn it on.

Certain conventional devices also have an "auto" setting which will power the device upon receiving an audio input and will typically stay on until the input has ceased for a certain length of time. However, because a powered speaker or device requires a few seconds to warm up, it will not be able to reproduce the first few seconds of audio input and, in the case of a short duration sound input (such as a movie sound effect), the device will not reproduce it at all. Conversely, after being turned on by audio input, powered speakers and devices may remain on for a significant and unnecessary length of time, which, again, may lead to unwanted ambient noise, energy consumption and potential damage to the internal circuitry.

Therefore, powered speakers and devices that are immediately energized or de-energized at the same time as the source unit are desired. Since powering the device based on audio input is too late to be completely effective, it would be desirable to coordinate energizing the device with the energizing of the source unit.

U.S. Pat. No. 6,744,150 to Rendic, issued Jun. 1, 2004, discloses an "outlet strip controlled by PC using low voltage powertap." Specifically, Rendic discloses a 110V AC power strip that will allow electrical current to any individual component plugged into it only upon receiving a 5V electrical input signal from a directing terminal via a low voltage connection such as a USB port. This device, however, is designed to use the low voltage conduits that are typical in computers as the input signal and would not be able to support a relatively high voltage input signal (typically 110V) that would come from a source device such as a stereo. Also, this reference is not designed to be internal to the powered speaker or device but is instead an external accessory with additional features such as a fuse or a circuit breaker, which would lead to potentially significant additional costs and less free space. Whatever the precise merits of this and other references, it does not achieve or fulfill the purposes of the present invention.

Therefore, a powered speaker that turns on only when the source unit is on is desired. Further, a powered speaker with reduced equipment wear and power consumption is desired.

SUMMARY OF THE INVENTION

The present invention provides a powered speaker, such as a subwoofer that may be turned on and off remotely by energizing the auxiliary AC power supply provided with an audio device or other source unit. The main power of the powered subwoofer is provided via a wall outlet or suitable power supply that may adequately supply the necessary power.

An embodiment of the invention comprises a powered speaker having an internal electrical relay. The relay includes an electromagnet in electrical communication with an actuation circuit. An actuation input is in electrical communication with the actuation circuit, wherein the actuation input is connectable to a switched output that is associated with an audio source unit. A manual switch selectively opens and closes the actuation circuit. A continuous power input is in electrical communication with an amplifier circuit, wherein the relay selectively opens and closes the amplifier circuit. An integral audio transducer is in electrical communication with the amplifier circuit.

Another embodiment of the present invention comprises a powered speaker, such as a subwoofer having an integral relay device for turning the powered speaker on and off. The integral relay device includes a pair of inputs. The device power input provides the power needed to energize the speaker and a plug means that plugs directly into a wall outlet or any suitable power source. The second input or the relay input comprises a plug means and plugs directly into the auxiliary power outlet provided on a device such as an audio receiver. The relay input utilizes the AC current provided from the auxiliary power output to energize the coil of the integral relay, thereby closing the relay and permitting the wall power to be feed directly to the powered speaker. Alternatively, the second input is in communication with a 12V DC remote turn-on lead and the relay utilizes the DC current to activate the relay.

The present invention operates by turning a powered speaker on and off, wherein said relay has a first input for receiving suitable AC power and a second input for actuating the contactor/relay. The method comprises the steps of plugging a first input into a wall AC outlet or suitable power supply, plugging a second input into the auxiliary power output of an audio receiver, energizing and de-energizing said audio receiver so that the auxiliary power source can turn on and off respectively, actuating and deactivating said relay/contactor, and turning the powered speaker on and off respectively.

An advantage of the present invention is a reduction in power consumption because the powered speaker turns on only when the source unit is on, and turns off immediately upon de-energizing the source unit thereby minimizing on time to time that the device is actually in use. Another advantage of the present invention is that the internal electronics of the powered speaker are powered up before any audio signals are sent to the unit. Therefore, the invention eliminates the delay of audio reproduction that occurs when a conventional unit is powering up after being actuated by the audio signal it is to reproduce.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
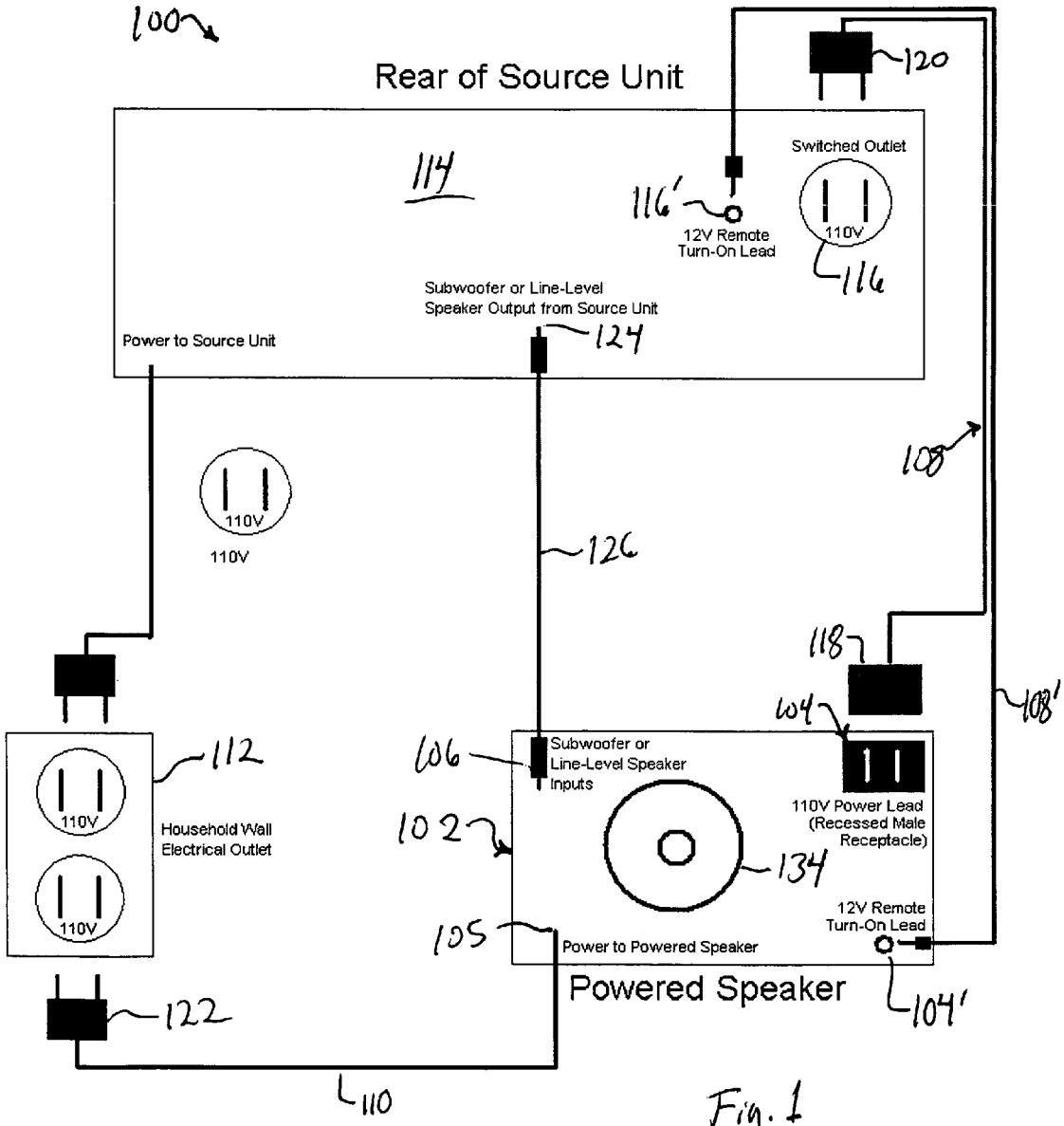
FIG. 1 is a schematic of the of the powered speaker of the present invention and other components in an audio system.

Referring to FIG. 1, there is shown the improved powered speaker 102 of the present invention and other components in an audio system 100. In addition to the powered speaker 102, the audio system 100 includes a source unit 114. The figure also includes a household electrical outlet 112, that serves to provide power to both the powered speaker 102 and the source unit 114. For the purpose of this specification, the term powered speaker is to be understood to include powered subwoofers, powered loudspeakers, and other powered audio transducers.

Figure 2:
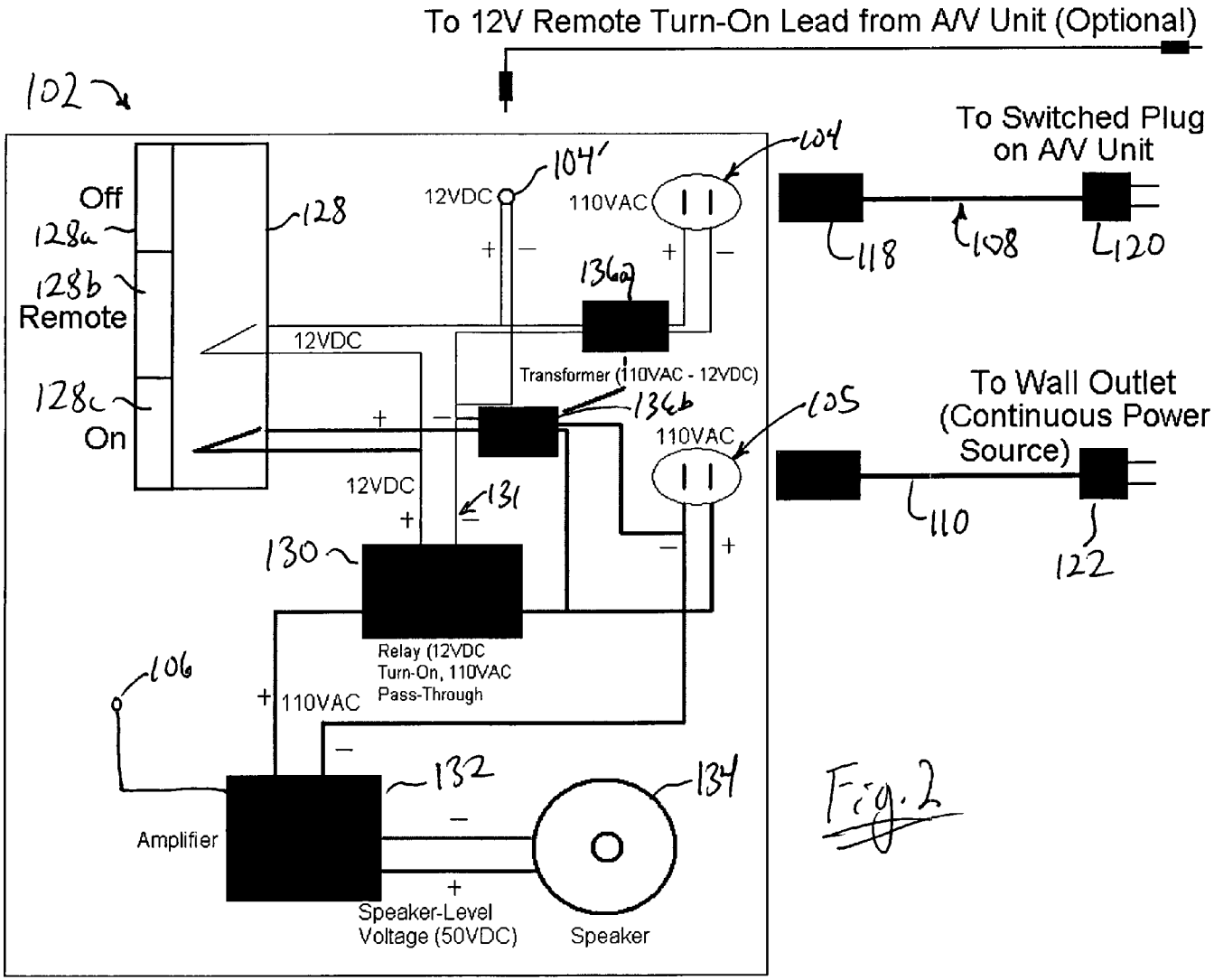
FIG. 2 is a electrical schematic of the powered speaker of FIG. 1.

The powered speaker 102, shown schematically in FIG. 2, includes an input 104 for receiving an actuation current, an input 105 for receiving the continuous power necessary to power the powered speaker 102, and the audio speaker input 106. In the illustrated embodiment, the actuation input 104 is a AC power plug. The input line 108 includes a receptacle 118 for engaging the actuator input 104 and a AC plug 120 on the opposing end of the input line 108 to engage a 110V switched outlet receptacle 116 on the source unit 114 (FIG. 1). An additional embodiment is contemplated wherein the input line 108 is hardwired to the powered speaker 102. In the present invention, AC power is provided to the switched outlet receptacle 116 when the source unit 114 is turned on. Some source units 114, especially high-end audio equipment, include a remote turn-on lead output 116' that sends a 12VDC current over a remote lead line 108' to an alternative actuation input 104'. The remote lead line 108' engages the alternative actuation input 104' and the remote turn-on lead output 116' with $\frac{1}{8}^{th}$-in jacks. According to the present embodiment, the powered speaker 102 may include the actuation input 104, the alternative actuation input 104', or both.

The power is supplied to the continuous power input 105 via a power cord 110 having a plug 122 that engages the household electrical outlet 112. As shown in FIG. 1, the audio input 106 is in electrical communication with a audio output 124 on the source unit 114 via a line level cable 126, which includes $\frac{1}{8}^{th}$-in jacks.

Referring to FIG. 2, the powered speaker 102 further includes a three-position switch 128, a relay 130, an amplifier 132 that is in electrical communication with the audio input 106, and an audio transducer 134. The switch 128 includes an off position 128*a*, a remote position 128*b*, and an on position 128*c*. When the switch 128 is in the remote position 128*b*, the actuation circuit is closed and the actuation input 104 is in electrical communication with an electromagnet side 131 of the relay 130 via a transformer 136*a*, which converts a 110VAC current to a 12VDC current. The alternative 12VDC actuation input 104' is also in electrical communication with the electromagnet side 131 of the relay 130 when the switch 128 is in the remote position 128*b*, however, the alternative actuation input 104' bypasses the transformer 136*a*.

When the switch 128 is placed in the on position 128*c*, the actuation bypass circuit is closed and the power input 105 is in electrical communication with the electromagnet side 131 of the relay 130. The 110VAC current from the power input 105 is converted to a 12VDC current prior to being passed to the electromagnet side 131 of the relay 130 by a transformer 136*b*. In this position, the relay 130 receives an actuation current regardless of whether the source unit 114 is activated as long as the power cord 110 is connected to power, such as by being plugged in to the electrical outlet 112.

When a 12VDC current is passed through the electromagnet side 131 of the relay 130 from either the actuation circuit or the actuation bypass circuit, the electromagnet is energized, and an armature in the relay 130 closes the amplifier circuit, placing the power input 105 in electrical communication with the amplifier 132. The amplifier 132 amplifies any signal from the audio input 106 and powers the transducer 134. When the switch 128 is in the off position 128*a*, the actuation circuit and the actuation bypass circuit are open and substantially no 110VAC power is supplied to the amplifier 132.

In operation, the AC plug 120 is plugged into switched outlet receptacle 116 of the source unit 114. The receptacle 118 on the opposing end of the contactor input line 108 is plugged into the actuator input 104. This configuration serves to provide the power necessary to energize the relay 130 located within the powered speaker 102. The AC power that is provided to the powered speaker 102 enters the powered speaker 102 through power cord 110. The plug 122 is plugged into electrical outlet 112, as illustrated in FIG. 1.

The user moves the switch 128 to the remote position 128*b* to allow the powered speaker 102 to be actuated by the source unit 114. When a 110VAC current is provided to the switched outlet 116 by the source unit 114, usually when the user turns on the source unit 114, the current is carried to the actuation input 104 by the input line 108. Since the actuation circuit is closed by the switch 128, the current is converted to a 12VDC current by the transformer 136*a* and passes through the electromagnet side 131 of the relay 130. Alternatively, a 12VDC actuation current is passed through the remote lead line 108' to the alternative actuation input 104', which is in electrical communication with the actuation circuit. The energized relay 130 closes the amplifier circuit, thereby providing power to the amplifier 132. The line level or subwoofer audio signal from the source unit 114 is communicated to the amplifier 132 through the audio cable 126 and the amplifier 132 amplifies the audio signal using power supplied by the amplifier circuit. The current between the amplifier 132 and the audio transducer 134 is at speaker level voltage, such as 50VDC. Because the powered speaker 102 is energized before an audio signal is sent by the source unit 114, performance is improved by assuring that a portion of the audio signal will not be lost due to a lag in turn on time.

Additionally the relay 132 is de-energized by removing or otherwise ceasing the flow of current to the actuation side 131. This de-energizing step is achieved by selectively turning off the source unit 114, and thereby removing power from the AC switched outlet 116. The de-energized relay 132 opens the amplifier circuit thereby shutting off the powered speaker 102. Therefore, when the switch 128 is in the remote position 128*b*, the operator is not required to manually turn off the powered speaker 102. Further, the speaker 102 does not remain on for several hours after it is no longer needed. The powered speaker 102 thereby avoids excessive power consumption and introduction of heat to the area where they are contained. Additionally, because the source unit 114 may include a remote control device that serves to turn the unit on and off, among other things, the powered speaker 102 used in the present invention may take advantage of the remote control device and be remotely turned on and off by the user.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A powered speaker comprising:

a speaker body;

an electrical relay that is selectively actuated based on the power status of an audio source unit, the relay being located within the speaker body and having an actuation circuit an actuation input in electrical communication with the actuation circuit, wherein the actuation input is connectable to an output power-line from the audio source unit, the actuation circuit being energized when the audio source unit is turned on and de-energized when the audio source unit is turned off;

a manual switch that selectively opens and closes the electrical relay;

a continuous power input in electrical communication with an amplifier circuit, wherein the electrical relay selectively opens and closes the amplifier circuit based on the ON/OFF power status of the audio source unit, the electrical relay being energized when the audio source unit is turned ON and de-energized when the audio source unit is turned OFF; and an integral audio transducer in electrical communication with the amplifier circuit.

2. The powered speaker of claim 1, wherein the output is a standard power outlet that selectively supplies an alternating current voltage of about 110 volts to the actuation input.

3. The powered speaker of claim 2, further comprising a transformer for converting the alternating current voltage to a direct current voltage of about 12 volts.

4. The powered speaker of claim 3, further comprising an alternate actuation input that is connectable to a turn-on lead associated with the audio source unit; wherein the turn-on lead supplies a direct current voltage of about 12 volts; and wherein the alternate actuation input is in electrical communication with the actuation circuit.

5. The powered speaker of claim 1, wherein the output is a turn-on lead that supplies a direct current voltage of about 12 volts to the actuation input.

6. The powered speaker of claim 1, further comprising an amplifier in electrical communication with the amplifier circuit, the audio transducer, and an audio source signal.

7. The powered speaker of claim 1, wherein the continuous power input is in electrical communication with an actuation bypass circuit;

wherein an electromagnet of the relay is in electrical communication with the actuation bypass circuit; and wherein the manual switch further selectively opens and closes the actuation bypass circuit.

8. The powered speaker of claim 7, wherein the continuous power input is in communication with a household wall outlet that supplies an alternating current voltage of about 110 volts.

9. The powered speaker of claim 8, further comprising a transformer that converts the alternating current voltage supplied to the actuation bypass circuit to a direct current voltage of about 12 volts.

10. A powered speaker comprising:

an integral relay for turning the powered speaker on and off by selectively actuating based on the ON/OFF power status of an audio source unit, the relay being energized when the audio source unit is turned ON and de-energized when the audio source unit is turned OFF;

said integral relay device having an output and an input;

said output provides a device power needed to energize the speaker when the relay is actuated via the relay output;

said input provides the actuation power to actuate the relay; and said actuation power is provided via an auxiliary power output from an audio source unit, the auxiliary power output being either a 120 V output or a 12 V output.

11. The powered speaker of claim 10 wherein said relay device is integral with said powered speaker.

12. The powered device of claim 10 wherein said device power is received from an AC wall outlet.

13. The powered device of claim 10 wherein said output further comprises an electrical plug.

14. The powered device of claim 10 wherein said input further comprises an electrical plug.

15. A powered speaker comprising:

a speaker body;

an electrical relay that is selectively actuated based on an audio source unit power status, the relay being located within the speaker body and having an actuation circuit;

an actuation input in electrical communication with the actuation circuit, wherein the actuation input is connectable to an output power-line from the audio source unit, the power-line being either a 12 V power-line or a 110 V power-line;

a manual switch that selectively opens and closes the actuation circuit; and a continuous power input in electrical communication with an amplifier circuit, wherein the electrical relay selectively opens and closes the amplifier circuit based on the ON/OFF power status of the audio source unit, the electrical relay being energized when the audio source unit is turned ON and de-energized when the audio source unit is turned OFF, the power signal being a 12 V power signal or a 110 V power signal, the power signal being received through the actuation input.

* * * * *